US009296397B2

(12) United States Patent
Morris

(10) Patent No.: US 9,296,397 B2
(45) Date of Patent: Mar. 29, 2016

(54) EMERGENCY OVERRIDE SYSTEM

(71) Applicant: PROGRESS RAIL SERVICES CORPORATION, Albertville, AL (US)

(72) Inventor: Paul Morris, Mayfield, KY (US)

(73) Assignee: Progress Rail Services Corporation, Albertville, AL (US)

( * ) Notice: Subject to any disclaimer, the term of this patent is extended or adjusted under 35 U.S.C. 154(b) by 185 days.

(21) Appl. No.: 13/778,702

(22) Filed: Feb. 27, 2013

(65) Prior Publication Data

US 2014/0239127 A1 Aug. 28, 2014

(51) Int. Cl.
*B61C 17/12* (2006.01)

(52) U.S. Cl.
CPC ..... *B61C 17/12* (2013.01)

(58) Field of Classification Search
CPC . B61L 2205/04; B61L 3/127; B61L 27/0022; B61L 27/0016; B61L 27/0027; B61L 17/00; B61L 25/025; B61L 27/0038; B61L 2207/02; B61L 25/021; B61L 25/023; B61L 29/28; B61L 3/006; B61L 15/0027
USPC ..... 701/2, 19, 20, 22, 93, 117, 301, 408; 246/126, 5, 186, 20, 27, 4
See application file for complete search history.

(56) References Cited

U.S. PATENT DOCUMENTS 4,687,258 A 8/1987 Astley
5,511,749 A 4/1996 Horst et al.
6,314,345 B1 * 11/2001 Coombes ..... 701/19
6,401,015 B1 * 6/2002 Stewart et al. ..... 701/19
6,470,245 B1 * 10/2002 Proulx ..... 701/19
6,633,800 B1 * 10/2003 Ward et al. ..... 701/2
6,691,005 B2 2/2004 Proulx
6,863,247 B2 * 3/2005 Horst ..... 246/187 A
6,975,927 B2 * 12/2005 Szklar et al. ..... 701/19
6,996,461 B2 * 2/2006 Kane et al. ..... 701/19
7,069,122 B1 * 6/2006 Higgs ..... 701/19
7,076,343 B2 * 7/2006 Kornick et al. ..... 701/19
7,177,732 B2 * 2/2007 Kraeling et al. ..... 701/19
7,203,228 B2 * 4/2007 Horst et al. ..... 375/222
7,653,465 B1 * 1/2010 Geiger et al. ..... 701/19
7,762,631 B2 * 7/2010 Smith ..... 303/7
7,922,127 B2 * 4/2011 Kumar et al. ..... 246/28 R
8,290,646 B2 10/2012 Ecton et al.
8,532,842 B2 * 9/2013 Smith et al. ..... 701/2
8,676,410 B2 * 3/2014 Houpt et al. ..... 701/19
8,868,267 B2 * 10/2014 Deitz et al. ..... 701/19
2001/0056544 A1 * 12/2001 Walker ..... 713/200
2004/0104311 A1 * 6/2004 Fernandez et al. ..... 246/167 R
2004/0249571 A1 * 12/2004 Blesener et al. ..... 701/301

(Continued)

FOREIGN PATENT DOCUMENTS

WO WO 99/05015 2/1999

*Primary Examiner* — Truc M Do
(74) *Attorney, Agent, or Firm* — Finnegan, Henderson, Farabow, Garrett & Dunner, LLP

(57) ABSTRACT

An emergency override system for a machine is disclosed. The emergency override system may have an input device configured to generate a stop signal. The emergency override system may also have a receiver configured to receive the stop signal. The emergency override system may further have a controller in communication with the receiver and connectable to a signal pin, which is configured to indicate a travel direction of the machine. The controller may be configured to stop a travel of the machine by applying a threshold voltage to the signal pin, when the receiver has received the stop signal.

19 Claims, 2 Drawing Sheets

(56) References Cited

U.S. PATENT DOCUMENTS

| | | | | |
|---|---|---|---|---|
| 2005/0103946 | A1* | 5/2005 | Lenz | 246/122 A |
| 2005/0253022 | A1 | 11/2005 | Peltz et al. | |
| 2007/0142984 | A1 | 6/2007 | Plawecki et al. | |
| 2008/0288131 | A1 | 11/2008 | Root et al. | |
| 2009/0125170 | A1* | 5/2009 | Noffsinger et al. | 701/20 |
| 2009/0248220 | A1* | 10/2009 | Ecton et al. | 701/2 |
| 2010/0235017 | A1* | 9/2010 | Peltonen et al. | 701/2 |
| 2012/0245766 | A1* | 9/2012 | Cooper et al. | 701/2 |

* cited by examiner

EMERGENCY OVERRIDE SYSTEM

TECHNICAL FIELD

The present disclosure relates generally to an emergency override system and, more particularly, to an emergency override system for a machine.

BACKGROUND

Rail car switching operations, for example, at a train yard, may involve maneuvering locomotives in an area crowded with other locomotives, railcars, and/or people. These operations may require a locomotive engineer to operate the locomotive, and at least one other person, for example, a switchman, on the ground to operate track switches and railcar cut levers. The engineer and the switchman may communicate with each other by radio and/or visual signals during the switching operations.

Typically, the engineer on board the locomotive can control the operations of the locomotive. These operations may include moving the locomotive in a forward or rearward direction and stopping the locomotive when desired. If the engineer becomes incapacitated or distracted, however, the engineer may not be able to stop a moving locomotive in a timely manner.

One attempt to address the problems described above is disclosed in International Patent Application Publication No. WO 99/05015 of Coombes that was published on Feb. 4, 1999 ("the '015 publication"). In particular, the '015 publication discloses a connection unit adapted to be connected to the train line and brake line connectors of a locomotive as part of a remote control system for the locomotive. The '015 publication further discloses that the connection unit may include a receiver for receiving remote control instructions, and a microprocessor to interpret the received remote control instructions and control the locomotive according to the remote control instructions. The '015 publication also discloses that the connection unit can apply or release the locomotive's brakes.

Although the '015 publication discloses a system for applying brakes to a locomotive, the disclosed system may still be problematic. For example, the system of the '015 publication may continue to apply tractive power to the wheels of the locomotive while simultaneously applying brakes in response to a remote instruction to stop the locomotive. This may cause excessive wear and tear of the brakes and fraction equipment. Moreover, it may cause the locomotive to continue moving if the brakes on the locomotive fail to operate.

The emergency override system of the present disclosure solves one or more of the problems set forth above and/or other problems in the art.

SUMMARY

In one aspect, the present disclosure is directed to an emergency override system for a machine. The emergency override system may include an input device configured to generate a stop signal. The emergency override system may also include a receiver configured to receive the stop signal. The emergency override system may further include a controller in communication with the receiver and connectable to a signal pin, which is configured to indicate a travel direction of the machine. The controller may be configured to stop a travel of the machine by applying a threshold voltage to the signal pin, when the receiver has received the stop signal.

In another aspect, the present disclosure is directed to a method of controlling a machine. The method may include generating a stop signal, using an input device. The method may also include receiving the stop signal, using a receiver. The method may further include applying a threshold voltage to a first signal pin and a second signal pin, when the stop signal is received. The first signal pin indicates a first travel direction and the second signal pin indicates a second travel direction of the machine. The method may also include stopping a supply of power to a traction motor of the machine, when the threshold voltage is applied to the first signal pin and the second signal pin.

DETAILED DESCRIPTION

Figure 1:
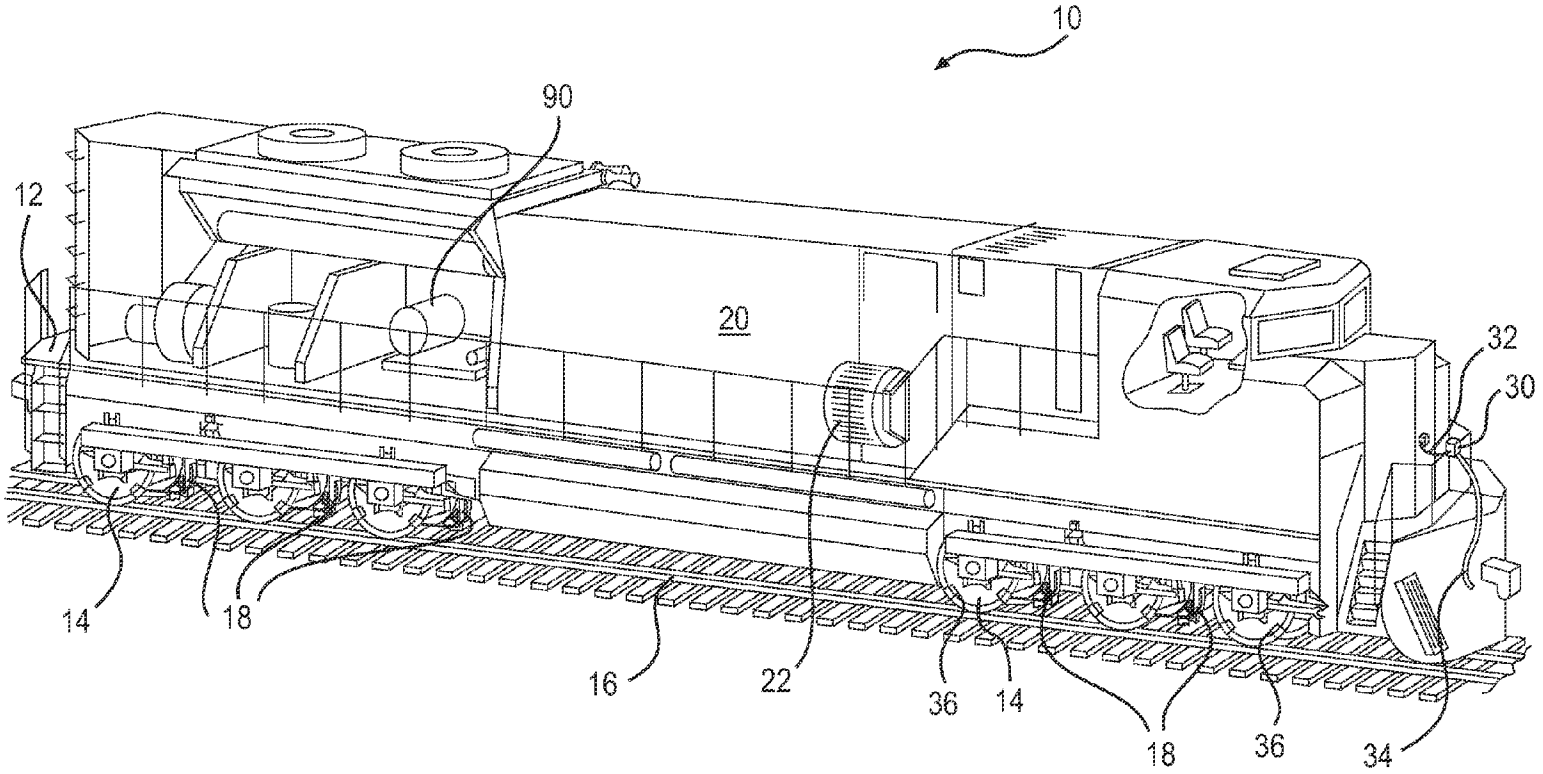
FIG. 1 is a pictorial illustration of an exemplary disclosed machine.

FIG. 1 illustrates an exemplary embodiment of a machine 10. For example, as shown in FIG. 1, machine 10 may be a locomotive designed to pull rolling stock. Machine 10 may have a platform 12. A plurality of wheels 14 may be configured to support platform 12. Wheels 14 may also be configured to engage a track 16. Each wheel 14 may have a traction motor 18 associated with it. Traction motors 18 may drive wheels 14 to propel machine 10 in a forward or rearward direction. It is contemplated that machine 10 may have a single traction motor 18 that drives the plurality of wheels 14. It is also contemplated that machine 10 may have a plurality of fraction motors 18, each of which may drive one or more wheels 14.

Machine 10 may have an engine 20 mounted on platform 12. Engine 20 may be configured to drive one or more generators 22, which may generate power to drive the one or more traction motors 18. The one or more generators 22 may also be mounted on platform 12 of machine 10. Although FIG. 1 depicts one engine 20, it is contemplated that machine 10 may have more than one engine 20, which may drive the one or more generators 22. In an exemplary embodiment as shown in FIG. 1, engine 20 may be lengthwise aligned on platform 12 along a travel direction of machine 10. One skilled in the art will recognize, however, that engine 20 may be located in tandem, transversally, or in any other orientation on platform 12.

Machine 10 may include an override device 30, which may be attached to machine 10 using hooks, bolts, ropes, wires, Velcro straps, or any other method of attachment known in the art. Override device 30 may be removable from machine 10 and attachable to a different machine 10, if desired. Thus, the same override device 30 may be useable by different operators, on different machines, and at different times, as desired. In one exemplary embodiment, override device 30 may be attached at one end of a walkway of a locomotive using a floating snap latch inserted into a walkway safety chain eyelet and two Velcro straps wrapped around a hand rail. Although a removable override device 30 has been described above, it is contemplated that override device 30 may be permanently attached to machine 10.

Override device 30 may be electrically connected to machine 10 via cable 32. Cable 32 may be provided with a plug (not shown) which may mate with a socket (not shown) on machine 10. In one exemplary embodiment, the socket may be a multiple unit (MU) train line socket. The socket may contain a plurality of signal pins, which may be used to control various operations of machine 10. In one exemplary embodiment, the socket may consist of a 27 signal pin MU receptacle. Electrically connecting override device 30 to machine 10 via the socket may allow override device 30 to control the various operations of machine 10 through the plurality of signal pins. For example, override device 30 may be useable for controlling movement of machine 10 in a forward or rearward direction, stopping machine 10, or performing any other operations of machine 10.

Override device 30 may also be connected to an air brake system 90 of machine 10 via hose 34. Once connected, override device 30 may be able to control air brake system 90 of machine 10 to apply or release brakes 36 on wheels 14. As illustrated in FIG. 1, air brake system 90 may be mounted on platform 12 of machine 10. In one exemplary embodiment, air brake system 90 may be a pressurized system in which brakes 36 on wheels 14 of machine 10 may remain in an inoperative or released position when a pressure of air within air brake system 90 is maintained at a desired pressure level. Air brake system 90 may apply brakes 36 to wheels 14, when the pressure in air brake system 90 is released, for example, by releasing the air in air brake system 90 to the atmosphere. One skilled in the art would recognize that air brake system 90 of machine 10 may include many components including, pumps, compressors, valves, etc., which may be required for operation of air brake system 90. One skilled in the art would also recognize that machine 10 may alternately or additionally be equipped with other types of brake systems known in the art.

Figure 2:
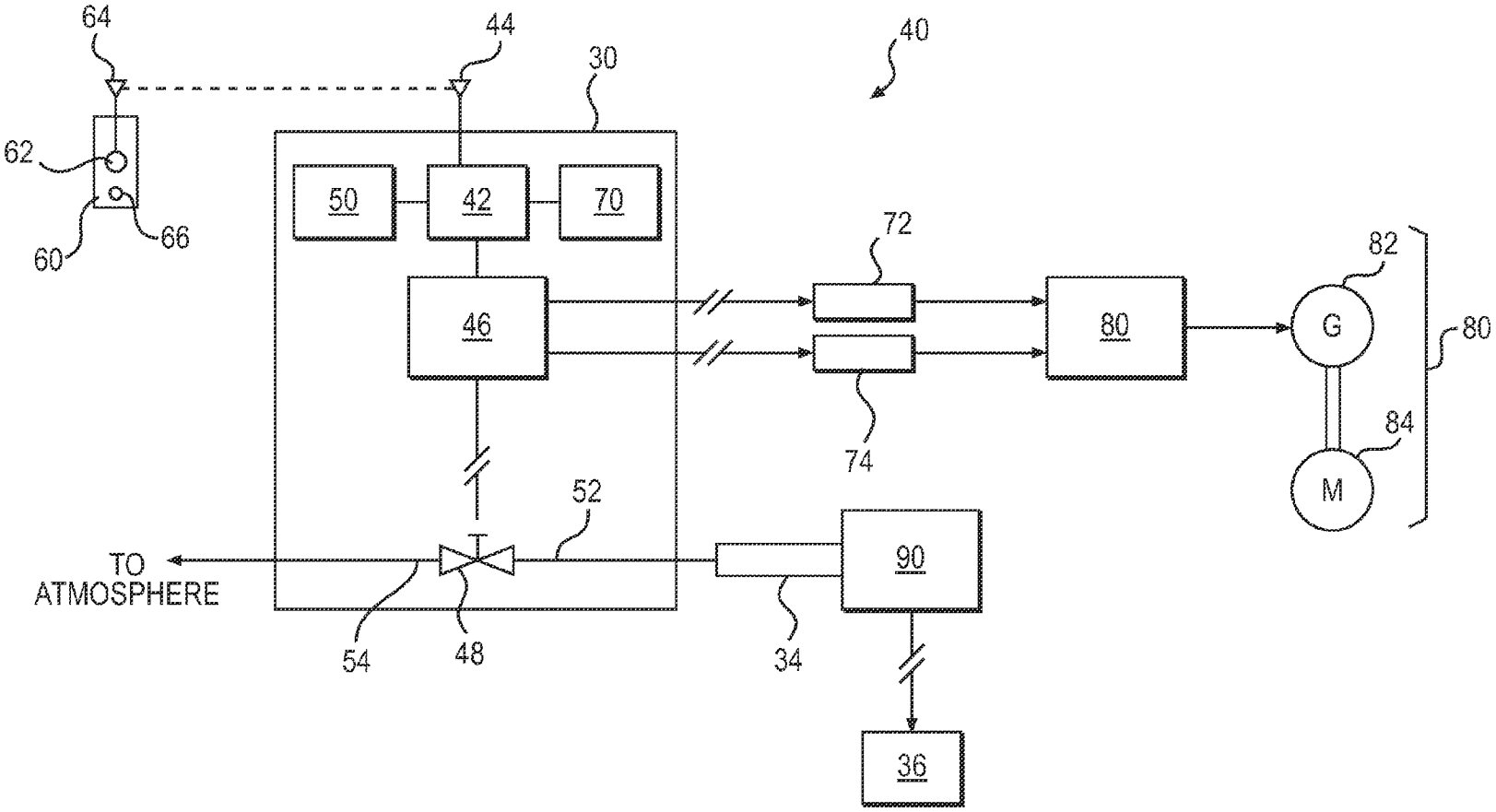
FIG. 2 is a schematic of an exemplary disclosed emergency override system for the machine of FIG. 1.

FIG. 2 illustrates an exemplary disclosed emergency override system 40 for machine 10. As shown in the figure, emergency override system 40 may include override device 30, remote control device 60, propulsion system 80, and air brake system 90. Override device 30 may include a receiver 42, antenna 44, controller 46, control valve 48, input device 50, and alarm 70. Receiver 42 may include components configured to receive a signal for directing operations of machine 10. For example, receiver 42 may contain network connections, data link connections, and/or other components configured to receive the signal. Antenna 44 may be associated with receiver 42 to allow receiver 42 to transmit and receive wireless signals. Override device 30 may include controller 46 which may be in communication with receiver 42 and control valve 48. Controller 46 may monitor receiver 42 at regular intervals to determine whether receiver 42 has received a signal. Controller 46 may direct control valve 48, alarm 70, or other mechanical or electrical components of machine 10 to perform operations according to the signal received by receiver 42. Override device 30 may include a battery or other power source which may provide power for operation of override device 30. It is contemplated that the battery or power source may be recharged using methods of recharging known in the art.

Remote control device 60 may communicate wirelessly with override device 30. Remote control device 60 may be equipped with an antenna 64 to transmit or receive signals. Remote control device 60 may also be equipped with one or more buttons 62. An operator holding remote control device 60 may activate one or more buttons 62 to control machine 10. It is contemplated that buttons 62 may be activated by touching, pressing, rotating, and/or moving buttons 62. Remote control device 60 may generate signals in response to activation of buttons 62. Remote control device 60 may transmit the signals through antenna 64. In one exemplary embodiment, button 62 may be a stop button 62, which may be configured to stop movement of machine 10.

Remote control device 60 may also be equipped with a beacon button 66, which may have a structure and method of activation similar to that of buttons 62. Remote control device 60 may be configured to transmit a beacon signal when an operator holding remote control device 60 activates beacon button 66. It is contemplated that in one exemplary embodiment, remote control device 60 may periodically transmit the beacon signal, without the need for an operator to activate beacon button 66. Controller 46 of override device 30 may monitor receiver 42 to determine a time interval between the beacon signal and a preceding beacon signal received by receiver 42. Controller 46 may stop movement of machine 10 and trigger alarm 70 when the time interval exceeds a threshold time interval. In one exemplary embodiment, the threshold time interval may be 10 minutes.

Controller 46 may be configured to estimate a distance between receiver 42 and remote control device 60 based on a strength of the beacon signal. Controller 46 may stop movement of machine 10 and trigger alarm 70, when the distance between receiver 42 and remote control device 60 exceeds a threshold distance. In one exemplary embodiment, the threshold distance may be 250 feet. After alarm 70 has been triggered, controller 46 may be configured to disable alarm 70 when a reverser handle (not shown) on machine 10 has been moved to a neutral position by an operator on machine 10.

Remote control device 60 may include a battery or other power source which may provide power for operation of remote control device 60. It is contemplated that the battery or power source may be recharged using methods of recharging known in the art. Remote control device 60 may include lights or other indicators, which may display or indicate the status of a transmitted or received signal or other information, such as the position, direction of motion, and speed of machine 10. It is contemplated that remote control device 60 may be equipped with digital and/or analog displays and/or alarms to communicate information regarding operation of machine 10 and the status of various mechanical and/or electrical systems of machine 10 to an operator using remote control device 60.

Remote control device 60 may be a portable computer, for example, a laptop computer, a tablet computer, or another mobile device known in the art. Remote control device 60 may include components such as a microprocessor, memory, and a display. Remote control device 60 may also include a keyboard, a stylus, or any other device known in the art and configured to provide inputs to remote control device 60.

Although FIG. 2 depicts override device 30 as receiving signals wirelessly via antenna 44, it is contemplated that override device 30 may receive signals via other methods known in the art. For example, override device 30 may be equipped with an input device 50 which may be used to input commands and/or signals into override device 30. Like remote control device 60, input device 50 may include components such as a microprocessor, memory, display, keyboard, stylus, or any other device known in the art and configured to provide inputs to input device 50. Additionally or alternatively, override device 30 may receive signals from other communications devices (not shown) via a wired connection, a network connection, a cellular connection, a satellite connection, or by any other means of communication known in the art.

Alarm 70 may be located within override device 30. Alternatively or additionally, alarm 70 may be located within a control cabin of machine 10, on remote control device 60, or at a central location for monitoring the status of one or more machines 10, for example, in a central control room or maintenance department. Alarm 70 may be audible, visual, or both.

Override device 30 may also be connected to propulsion system 80, which may include first signal pin 72, second signal pin 74, motor controller 82, generator 22, and traction motor 18. Controller 46 may be in communication with first signal pin 72 and second signal pin 74. Controller 46 may be configured to raise first signal pin 72 and/or second signal pin 74 to a high voltage state in response to signals received by receiver 42. First signal pin 72 may indicate a first travel direction for machine 10, when raised to a high voltage state. Second signal pin 74 may indicate a second travel direction of machine 10, when raised to a high voltage state. The second travel direction of machine 10 may be opposite to the first travel direction. In one exemplary embodiment, first signal pin 72 may be train line pin 8 and second signal pin 74 may be train line pin 9, or vice-versa. As used in this disclosure, controller 46 may raise first and/or second signal pins 72, 74 to a high voltage state by applying a voltage to first or second signal pins 72, 74, respectively. In one exemplary embodiment, controller 46 may apply a threshold voltage to first or second signal pins 72, 74. Thus, first signal pin 72 may indicate the first travel direction of machine 10 when the threshold voltage has been applied to the first signal pin 72. Similarly, second signal pin 74 may indicate the second travel direction of machine 10 when the threshold voltage has been applied to second signal pin 74. Controller 46 may apply the threshold voltage to both the first signal pin 72 and the second signal pin 74 to stop the travel of machine 10. In another exemplary embodiment, when machine 10 is moving in the first or the second travel direction, controller 46 may communicate the threshold voltage from first signal pin 72 to the second signal pin 74, or vice-versa, to stop the movement of machine 10.

Motor controller 82 may be in communication with first and second signal pins 72, 74. Motor controller 82 may be configured to monitor the voltage state of first and second signal pins 72, 74. Motor controller 82 may direct generator 22 to supply power to traction motor 18 to propel machine 10. Motor controller 82 may also direct traction motor 18 to drive wheels 14 in a clockwise or a counter-clockwise direction to propel machine 10 in the first travel direction or the second travel direction based on the voltage state of first and second signal pins 72, 74, respectively. Motor controller 82 may be configured to direct generator 22 to stop supplying power to traction motor 18 when both first and second signal pins 72, 74 are at a high voltage state. In other words, when motor controller 82 detects that the threshold voltage has been applied to both the first signal pin 72 and the second signal pin 74, motor controller 82 may direct generator 22 to stop supplying power to traction motor 18.

Although, FIG. 2 depicts two signal pins 72, 74, it is contemplated that, in some exemplary embodiments, first signal pin 72 alone may indicate a travel direction of machine 10. For example, first signal pin 72 may indicate the first travel direction when a first voltage is applied to first signal pin 72, and a second travel direction when a second voltage is applied to first signal pin 72. It is further contemplated that motor controller 82 may direct generator 22 to stop supplying power to traction motor 18 when the threshold voltage is applied to first signal pin 72. Thus, in this exemplary embodiment, controller 46 may stop the travel of machine 10 by applying the threshold voltage to first signal pin 72. It is also contemplated that, in some exemplary embodiments, second signal pin 74 alone may indicate a travel direction of machine 10 and may operate in a manner similar to first signal pin 72.

Override device 30 may also be connected to air brake system 90 via hose 34, which may be connected to an inlet 52 of control valve 48. An outlet 54 of control valve 48 may be open to the atmosphere. Controller 46 may be in communication with control valve 48 during operation of machine 10. Controller 46 may adjust control valve 48 to release some or all of the air within air brake system 90 to the atmosphere. For example, when receiver 42 has received a stop signal, controller 46 may engage air brake system 90 by opening control valve 48 and allowing air from air brake system 90 to be released to the atmosphere causing air brake system 90 to apply brakes 36 to wheels 14 of machine 10.

Controller 46 may embody a single microprocessor or multiple microprocessors, field programmable gate arrays (FPGAs), digital signal processors (DSPs), etc. Controller 46 may be configured to control operations of machine 10. Additionally or alternatively, controller 46 may be configured to communicate with another controller (not shown), which may be configured to control operations of machine 10. Various other known circuits may be associated with controller 46, including power supply circuitry, signal-conditioning circuitry, actuator driver circuitry (i.e., circuitry powering solenoids, motors, or piezo actuators), communication circuitry, and other appropriate circuitry. Motor controller 82 may have a structure and method of operation similar to that of controller 46. It is contemplated that, controller 46 may perform functions of motor controller 82 or vice-versa.

Control valve 48 may be a two position or proportional type valve having a valve element movable to release air from hose 34 to the atmosphere. The valve element in control valve 48 may be hydraulic or pneumatic and may be solenoid-operable to move between a flow-passing position and a flow-blocking position. It is also contemplated that the valve element in control valve 48 may be operable in any other manner known in the art. In the flow-passing position, control valve 48 may permit air to flow out from air brake system 90 through hose 34 to the atmosphere, causing air brake system 90 to apply brakes 36 to wheels 14. In contrast, in the flow-blocking position, control valve 48 may completely block air from flowing through hose 34, allowing air brake system 90 to release brakes 36 on wheels 14.

An exemplary operation of emergency override system 40 will be described next.

INDUSTRIAL APPLICABILITY

The disclosed emergency override system may be used in any machine or power system application where it is beneficial to allow control of the machine by a remote operator. The disclosed emergency override system may find particular applicability with mobile machines such as locomotives during switching operations in a railway yard. The disclosed emergency override system may provide an improved method for controlling the movement of the machine, when an operator of the machine becomes incapacitated or distracted. For example, the disclosed emergency override system may provide an improved method for stopping a moving machine in an emergency both by disabling a tractive power source of the machine and by applying brakes to the machine. Operation of emergency override system 40 will now be described.

During operation of machine 10, a first operator may be located on machine 10 and may be capable of operating machine 10. A second operator may be located on the ground remote from machine 10. The second operator may desire to stop machine 10 in an emergency. The second operator may activate a stop button 62 on remote control device 60, which may generate a stop signal in response to activation of the stop button 62. Remote control device 60 may transmit the stop signal through antenna 64. Receiver 42 may receive the stop signal in cooperation with antenna 44. Controller 46 may monitor receiver 42 at regular intervals to determine whether receiver 42 has received a signal. When controller 46 detects that receiver 42 has received the stop signal, controller 46 may apply the threshold voltage to both first and second signal pins 72, 74. Motor controller 82 may monitor the voltage state of first and second signal pins 72, 74 at regular intervals. When motor controller 82 detects that the threshold voltage has been applied to both the first and second signal pins 72, 74, motor controller 82 may direct generator 22 to stop supplying power to traction motor 18.

Controller 46 may also move a valve element in control valve 48 to a flow passing position, allowing air within air brake system 90 to be released to the atmosphere, when receiver 42 has received a stop signal. Release of air from air brake system 90 may cause brakes 36 to be applied to wheels 14 of machine 10. Thus, by stopping the power supply to traction motor 18 and by applying brakes 36 to wheels 14, override device 30 may cause machine 10 to stop travelling in the first or second travel directions in response to the stop signal. Moreover, by stopping the power supply to traction motor 18, emergency override system 40 may ensure that the travel of machine 10 can be stopped even if brakes 36 fail to operate. In addition, by stopping the power supply to traction motor 18, emergency override system 40 may help reduce wear and tear of brakes 36 and propulsion system 80.

During operation of machine 10, the second operator may be required to periodically activate beacon button 66. When the second operator activates beacon button 66, remote control device 60 may generate a beacon signal. Remote control device 60 may transmit the beacon signal through antenna 64. Receiver 42, in cooperation with antenna 44, may receive the beacon signal transmitted by remote control device 60. Controller 46 may determine a time interval between the beacon signal and a preceding beacon signal. When the time interval exceeds a threshold time interval, controller 46 may trigger alarm 70. Controller 46 may also initiate an emergency stop of machine 10 by applying the threshold voltage to the first and second signal pins 72, 74 and by opening control valve 48 to apply brakes 36 to wheels 14.

Controller 46 may measure a strength of the beacon signal received by receiver 42. Controller 46 may use an amplitude of the beacon signal as a measure of the signal strength. It is contemplated that controller 46 may use other characteristics of the signal as a measure of the signal strength, for example, an amount of power transmitted by antenna 64. Controller 46 may use the measured strength to estimate a distance between remote control device 60 and receiver 42. Controller 46 may estimate the distance by receiving signals from other nearby communications devices, satellites, etc. whose positions are known to controller 46. Controller 46 may triangulate the position of receiver 42 and remote control device 60 relative to the other communications devices and or satellites based on the strength of the signal received from remote control device 62 and the known positions of the other communications devices or satellites. Controller 46 may determine the distance between remote control device 60 and receiver 42 based on the triangulation. One skilled in the art would recognize that controller 46 may use many other techniques known in the art to determine the distance between remote control device 60 and receiver 42 using various characteristics of the beacon signal. When the estimated distance exceeds the threshold distance, controller 46 may trigger alarm 70. Controller 46 may also initiate an emergency stop of machine 10 by applying the threshold voltage to the first and second signal pins 72, 74 and by opening control valve 48 to apply brakes 36 to wheels 14.

It will be apparent to those skilled in the art that various modifications and variations can be made to the disclosed emergency override system without departing from the scope of the disclosure. Other embodiments of the emergency override system will be apparent to those skilled in the art from consideration of the specification and practice of the emergency override system disclosed herein. It is intended that the specification and examples be considered as exemplary only, with a true scope of the disclosure being indicated by the following claims and their equivalents.

What is claimed is:

1. An emergency override system for a machine, comprising:

an input device configured to generate a stop signal;

a receiver configured to receive the stop signal;

a controller in communication with the receiver and connectable to a first signal pin and a second signal pin;

the first signal pin configured to indicate a first travel direction of the machine;

the second signal pin configured to indicate a second travel direction of the machine; and the controller being configured to stop a travel of the machine by applying a threshold voltage to the first signal pin and the second signal pin, when the receiver has received the stop signal.

2. The emergency override system of claim 1, wherein the controller is connectable to an air brake system of the machine, and the controller is configured to stop the travel of the machine by releasing air from the air brake system to the atmosphere, when the receiver has received the stop signal.

3. The emergency override system of claim 2, further including a control valve connectable to the air brake system of the machine, wherein the controller is configured to release the air from the air brake system by opening the control valve.

4. The emergency override system of claim 3, wherein the input device is a remote control device configured to transmit the stop signal to the receiver.

5. The emergency override system of claim 4, wherein the remote control device is configured to transmit the stop signal to the receiver, when a distance between the remote control device and the receiver exceeds a threshold distance.

6. The emergency override system of claim 4, wherein the controller is configured to stop the travel of the machine when a distance between the remote control device and the receiver exceeds a threshold distance.

7. The emergency override system of claim 4, wherein the remote control device is further configured to periodically transmit a beacon signal to the receiver.

8. The emergency override system of claim 7, wherein:

the receiver is configured to receive the beacon signal; and the controller is configured to:

determine a time interval between the beacon signal and a preceding beacon signal; and stop the travel of the machine when the time interval exceeds a threshold time interval.

9. The emergency override system of claim 8, wherein the remote control device further includes:

a stop button configured to generate the stop signal when the stop button is activated; and a beacon button configured to generate the beacon signal when the beacon button is activated.

10. A method of controlling a machine, comprising:

generating a stop signal, using a remote control device;

receiving the stop signal, using a receiver;

applying a threshold voltage to a first signal pin and a second signal pin, when the stop signal is received, wherein the first signal pin indicates a first travel direction and the second signal pin indicates a second travel direction of the machine; and stopping a supply of power to a traction motor of the machine, when the threshold voltage is applied to the first signal pin and the second signal pin.

11. The method of claim 10, further including transmitting the stop signal to the receiver.

12. The method of claim 11, further including:

opening a control valve connected to an air brake system of the machine;

releasing air from the air brake system to the atmosphere; and applying brakes to wheels of the machine.

13. The method of claim 12, further including:

activating a stop button on the remote control device; and generating the stop signal in response to activation of the stop button.

14. The method of claim 12, further including transmitting the stop signal when a distance between the remote control device and the receiver exceeds a threshold distance.

15. The method of claim 12, further including applying the threshold voltage to the first signal pin and the second signal pin when a distance between the remote control device and the receiver exceeds a threshold distance.

16. The method of claim 12, further including:

periodically transmitting a beacon signal from the remote control device to the receiver;

determining a time interval between the beacon signal and a preceding beacon signal received by the receiver; and applying the threshold voltage to the first signal pin and the second signal pin, when the time interval exceeds a threshold time interval.

17. The method of claim 16, further including:

activating a beacon button on the remote control device; and generating the beacon signal in response to activation of the beacon button.

18. A mobile machine comprising:

a first signal pin configured to indicate a first travel direction of the machine;

a second signal pin configured to indicate a second travel direction of the machine;

a platform;

a plurality of wheels configured to support the platform;

a traction motor coupled to the plurality of wheels and configured to:

propel the machine in the first travel direction, when a threshold voltage is applied to the first signal pin; and propel the machine in the second travel direction, when the threshold voltage is applied to the second signal pin;

a generator configured to supply power to the traction motor;

an override device, including a receiver configured to receive a stop signal; and a controller in communication with the receiver and configured to apply the threshold voltage to the first signal pin and the second signal pin, when the receiver has received the stop signal; and a motor controller configured to direct the generator to stop supplying the power to the traction motor, when the controller has applied the threshold voltage to the first signal pin and the second signal pin.

19. The mobile machine of claim 18, further including:

an air brake system configured to apply brakes to the plurality of wheels; and a control valve connected to the air brake system, wherein the controller is further configured to open the control valve and release air from the air brake system to the atmosphere, when the receiver has received the stop signal.

* * * * *